US009057338B2

(12) United States Patent
Levijoki et al.

(10) Patent No.: US 9,057,338 B2
(45) Date of Patent: Jun. 16, 2015

(54) EXHAUST GAS OXYGEN SENSOR FAULT DETECTION SYSTEMS AND METHODS USING FUEL VAPOR PURGE RATE

(71) Applicant: GM GLOBAL TECHNOLOGY OPERATIONS LLC, Detroit, MI (US)

(72) Inventors: Stephen Paul Levijoki, Swartz Creek, MI (US); Paul William Rasmussen, Milford, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 365 days.

(21) Appl. No.: 13/673,325

(22) Filed: Nov. 9, 2012

(65) Prior Publication Data

US 2014/0130785 A1 May 15, 2014

(51) Int. Cl.

| | |
|---|---|
| ***F02D 41/22*** | (2006.01) |
| ***F02D 41/14*** | (2006.01) |
| ***F02D 41/00*** | (2006.01) |
| *F02D 41/02* | (2006.01) |

(52) U.S. Cl.

CPC ..... *F02D 41/1441* (2013.01); *F02D 41/0295* (2013.01); *F02D 41/1458* (2013.01); *F02D 41/1495* (2013.01); *F02D 41/0042* (2013.01)

(58) Field of Classification Search

CPC ..... F02D 41/1441; F02D 41/1495; F02D 41/0042; F02D 41/1458; F02D 41/0295; F02D 41/22

USPC ..... 123/672, 690, 516, 518; 701/103, 107, 701/109

See application file for complete search history.

(56) References Cited

U.S. PATENT DOCUMENTS

| | | | |
|---|---|---|---|
| 4,214,308 | A | 7/1980 | Carp |
| 4,928,518 | A | 5/1990 | Tamura |
| 5,357,791 | A | 10/1994 | Gee et al. |
| 5,390,650 | A | 2/1995 | Gee et al. |
| 5,485,382 | A | 1/1996 | Seki et al. |
| 5,666,925 | A | 9/1997 | Denz et al. |
| 5,970,967 | A | 10/1999 | Uchikawa |

(Continued)

FOREIGN PATENT DOCUMENTS

| | | | |
|---|---|---|---|
| DE | 38 34 711 | A1 | 4/1990 |
| DE | 4333412 | A1 | 4/1995 |

(Continued)

OTHER PUBLICATIONS

U.S. Appl. No. 13/672,231, filed Nov. 8, 2012, Levijoki et al.

(Continued)

*Primary Examiner* — Hai Huynh

(57) ABSTRACT

A diagnostic system for a vehicle includes an error module, an equivalence ratio (EQR) module, a threshold determination module, and a fault indication module. The error module determines an error value based on a difference between an amount of oxygen in exhaust measured by an exhaust gas oxygen sensor (EGO) upstream of a catalyst and an expected value of the amount. The EQR module selectively controls fuel injection based on the error value. The threshold determination module determines an error threshold based on a flow rate of fuel vapor from a vapor canister to an intake manifold of an engine. The fault indication module selectively indicates that a fault is present in the EGO sensor based on the error value and the error threshold.

20 Claims, 6 Drawing Sheets

(56) References Cited

U.S. PATENT DOCUMENTS

| | | | |
|---|---|---|---|
| 7,266,942 | B2 | 9/2007 | Iihoshi et al. |
| 7,549,284 | B2 | 6/2009 | Iihoshi et al. |
| 7,900,616 | B2 | 3/2011 | Saunders |
| 7,937,209 | B2 | 5/2011 | Dudek et al. |
| 2005/0262828 | A1 | 12/2005 | Iihoshi et al. |
| 2008/0028828 | A1 | 2/2008 | Iihoshi et al. |
| 2009/0048766 | A1 | 2/2009 | Dudek et al. |
| 2009/0182490 | A1 | 7/2009 | Saunders |
| 2013/0104626 | A1 | 5/2013 | Levijoki et al. |

FOREIGN PATENT DOCUMENTS

| | | | |
|---|---|---|---|
| DE | 19518292 | A1 | 11/1996 |
| DE | 694 05 615 | T2 | 1/1998 |
| DE | 69407685 | T2 | 4/1998 |
| DE | 103 31 334 | A1 | 2/2005 |
| DE | 102008037634 | A1 | 5/2009 |
| DE | 10 2010 022 683 | A1 | 4/2011 |
| DE | 102012219626 | A1 | 5/2013 |
| EP | 0616121 | A1 | 9/1994 |
| EP | 1600619 | A2 | 11/2005 |
| JP | H09242587 | A | 9/1997 |

OTHER PUBLICATIONS

U.S. Appl. No. 14/074,790, filed Nov. 8, 2013, Levijoki et al.

U.S. Appl. No. 13/286,717, filed Nov. 1, 2011, Levijoki et al.

Office Action dated Sep. 10, 2014, from the German Patent Office for German Patent Application No. 10 2013 214 541.1; 7 pages.

Office Action dated Jan. 30, 2015, from the German Patent Office for German Patent Application No. 10 2013 222 502.4; 7 pages.

EXHAUST GAS OXYGEN SENSOR FAULT DETECTION SYSTEMS AND METHODS USING FUEL VAPOR PURGE RATE

FIELD

The present disclosure relates to internal combustion engines and more specifically to fuel control systems and methods.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A fuel control system controls provision of fuel to an engine. The fuel control system includes an inner control loop and an outer control loop. The inner control loop may use data from an exhaust gas oxygen (EGO) sensor located upstream from a catalyst in an exhaust system. The catalyst receives exhaust gas output by the engine.

The inner control loop controls the amount of fuel provided to the engine based on the data from the upstream EGO sensor. For example only, when the upstream EGO sensor indicates that the exhaust gas is (fuel) rich, the inner control loop may decrease the amount of fuel provided to the engine. Conversely, the inner control loop may increase the amount of fuel provided to the engine when the exhaust gas is lean. Adjusting the amount of fuel provided to the engine based on the data from the upstream EGO sensor modulates the air/fuel mixture combusted within the engine at approximately a desired air/fuel mixture (e.g., a stoichiometry mixture).

The outer control loop may use data from an EGO sensor located downstream from the catalyst. For example only, the outer control loop may use the response of the upstream and downstream EGO sensors to determine an amount of oxygen stored by the catalyst and other suitable parameters. The outer control loop may also use the response of the downstream EGO sensor to correct the response of the upstream and/or downstream EGO sensors when the downstream EGO sensor provides an unexpected response.

SUMMARY

A diagnostic system for a vehicle includes an error module, an equivalence ratio (EQR) module, a threshold determination module, and a fault indication module. The error module determines an error value based on a difference between an amount of oxygen in exhaust measured by an exhaust gas oxygen sensor (EGO) upstream of a catalyst and an expected value of the amount. The EQR module selectively controls fuel injection based on the error value. The threshold determination module determines an error threshold based on a flow rate of fuel vapor from a vapor canister to an intake manifold of an engine. The fault indication module selectively indicates that a fault is present in the EGO sensor based on the error value and the error threshold.

A diagnostic method for a vehicle includes: determining an error value based on a difference between an amount of oxygen in exhaust measured by an exhaust gas oxygen sensor (EGO) upstream of a catalyst and an expected value of the amount; and selectively controlling fuel injection based on the error value. The diagnostic method further includes: determining an error threshold based on a flow rate of fuel vapor from a vapor canister to an intake manifold of an engine; and selectively indicating that a fault is present in the EGO sensor based on the error value and the error threshold.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
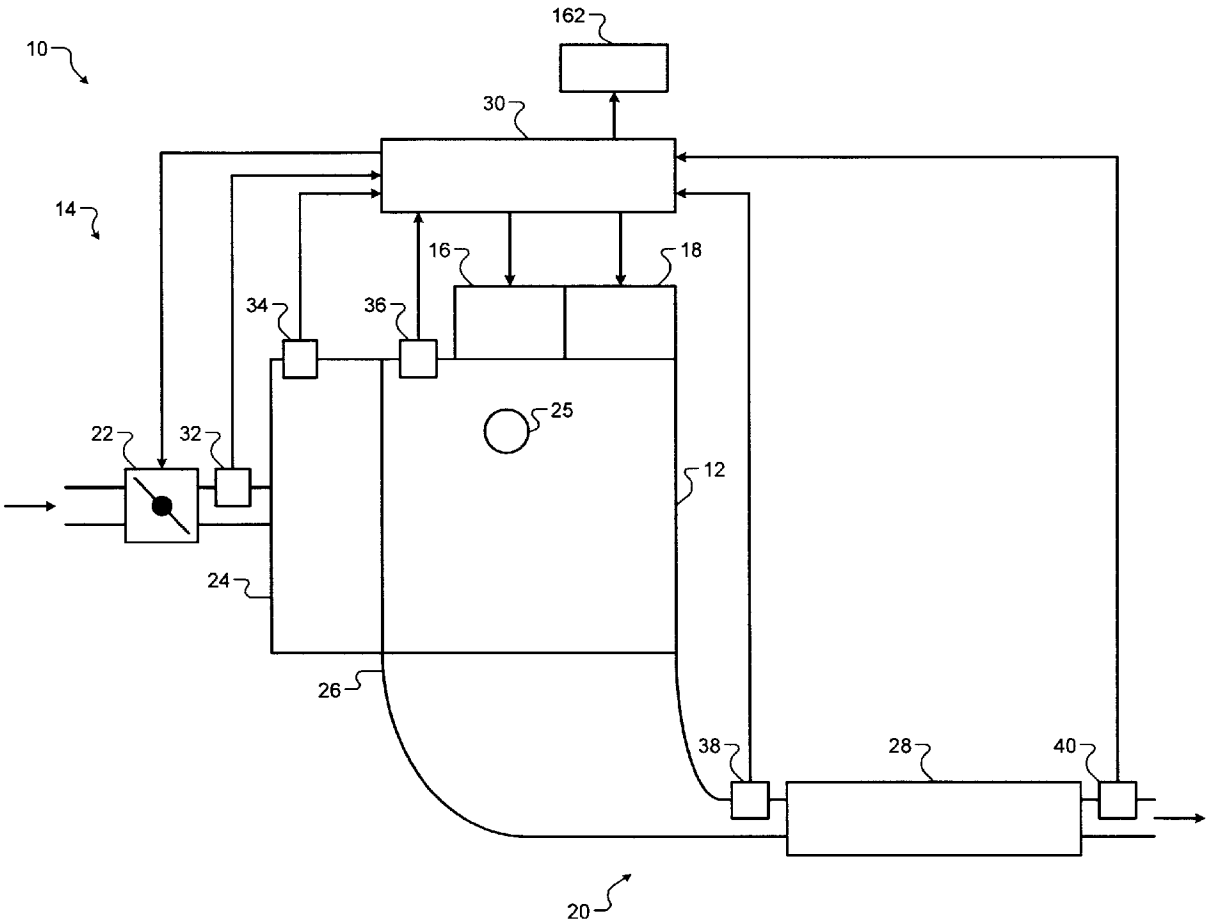
FIG. 1 is a functional block diagram of an example engine system according to the present application.

An engine combusts a mixture of air and fuel to produce torque. Fuel injectors may inject liquid fuel drawn from a fuel tank. Some conditions, such as heat, radiation, and fuel type may cause fuel to vaporize within the fuel tank. A vapor canister traps fuel vapor, and the fuel vapor may be drawn from the vapor canister to the engine. The engine expels exhaust to an exhaust system. An exhaust gas oxygen (EGO) sensor measures an amount of oxygen in the exhaust upstream of a catalyst. EGO sensors may also be referred to as air/fuel sensors. Wide range air/fuel (WRAF) sensors and universal EGO (UEGO) sensors measure values between values indicative of rich and lean operation, while switching EGO and switching air/fuel sensors toggle between the values indicative of rich and lean operation.

An engine control module (ECM) controls fuel injection. In implementations involving WRAF or UEGO sensors, the ECM determines an error value based on a difference between the amount of oxygen measured by the EGO sensor at a given time and a predicted value of the amount of oxygen that will be measured by the EGO sensor at the given time. In implementations involving switching sensors, the ECM may determine the error value based on a period that the switching sensor indicates that it is not in a commanded state (rich or lean). For example, if the commanded state is rich, the ECM may determine the error value based on the period that the switching sensor indicates lean operation after the transition to the rich state is commanded. If the commanded state is lean, the ECM may determine the error value based on the period that the switching sensor indicates rich operation after the transition to the lean state is commanded. The ECM selectively adjusts fuel injection based on the error value. For purposes of discussion, both air/fuel sensors and EGO sensors will be referred to as EGO sensors.

The ECM also determines whether a fault is present in the EGO sensor based on a comparison of the error value and a predetermined error value. More specifically, the ECM may determine that a fault is present in the EGO sensor when the error value is greater than the predetermined error value. The error value becoming greater than the predetermined error value indicates that the EGO sensor is not responding (i.e., stuck) or responding too slowly to the commanded conditions. The predetermined error value may be set based on the error value above which the engine may operate roughly and/or stall.

In some circumstances, however, the engine may not operate roughly and/or stall while the error value is greater than the predetermined error value. For example only, the engine may not operate roughly and/or stall while fuel vapor is being provided to the engine from the vapor canister even though the error value is greater than the predetermined error value. The ECM of the present application therefore adjusts the predetermined error value based on an amount of fuel vapor (e.g., mass flow rate, mass, etc.) being provided to the engine.

Referring now to FIG. 1, a functional block diagram of an example engine system 10 is presented. The engine system 10 includes an engine 12, an intake system 14, a fuel injection system 16, an ignition system 18, and an exhaust system 20. While the engine system 10 is shown and will be described in terms of a gasoline engine, the present application is applicable to diesel engine systems, hybrid engine systems, and other suitable types of engine systems having a fuel vapor purge system.

The intake system 14 may include a throttle 22 and an intake manifold 24. The throttle 22 controls air flow into the intake manifold 24. Air flows from the intake manifold 24 into one or more cylinders within the engine 12, such as cylinder 25. While only the cylinder 25 is shown, the engine 12 may include more than one cylinder. The fuel injection system 16 includes a plurality of fuel injectors and controls (liquid) fuel injection for the engine 12. As discussed further below (e.g., see FIG. 2), fuel vapor is also selectively provided to the engine 12 via the intake system 14.

Exhaust resulting from combustion of the air/fuel mixture is expelled from the engine 12 to the exhaust system 20. The exhaust system 20 includes an exhaust manifold 26 and a catalyst 28. For example only, the catalyst 28 may include a three way catalyst (TWC) and/or another suitable type of catalyst. The catalyst 28 receives the exhaust output by the engine 12 and reacts with various components of the exhaust.

The engine system 10 also includes an engine control module (ECM) 30 that regulates operation of the engine system 10. The ECM 30 communicates with the intake system 14, the fuel injection system 16, and the ignition system 18. The ECM 30 also communicates with various sensors. For example only, the ECM 30 may communicate with a mass air flow (MAF) sensor 32, a manifold air pressure (MAP) sensor 34, a crankshaft position sensor 36, and other suitable sensors.

The MAF sensor 32 measures a mass flowrate of air flowing into the intake manifold 24 and generates a MAF signal based on the mass flowrate. The MAP sensor 34 measures pressure within the intake manifold 24 and generates a MAP signal based on the pressure. In some implementations, vacuum within the intake manifold 24 may be measured relative to ambient pressure.

The crankshaft position sensor 36 monitors rotation of a crankshaft (not shown) of the engine 12 and generates a crankshaft position signal based on the rotation of the crankshaft. The crankshaft position signal may be used to determine an engine speed (e.g., in revolutions per minute). The crankshaft position signal may also be used for cylinder identification and one or more other suitable purposes.

The ECM 30 also communicates with exhaust gas oxygen (EGO) sensors associated with the exhaust system 20. For example only, the ECM 30 communicates with an upstream EGO sensor (US EGO sensor) 38 and a downstream EGO sensor (DS EGO sensor) 40. The US EGO sensor 38 is located upstream of the catalyst 28, and the DS EGO sensor 40 is located downstream of the catalyst 28. The US EGO sensor 38 may be located, for example, at a confluence point of exhaust runners (not shown) of the exhaust manifold 26 or at another suitable location.

The US and DS EGO sensors 38 and 40 measure amounts of oxygen in the exhaust at their respective locations and generate EGO signals based on the amounts of oxygen. For example only, the US EGO sensor 38 generates an upstream EGO (US EGO) signal based on the amount of oxygen upstream of the catalyst 28. The DS EGO sensor 40 generates a downstream EGO (DS EGO) signal based on the amount of oxygen downstream of the catalyst 28.

The US and DS EGO sensors 38 and 40 may each include a switching EGO sensor, a universal EGO (UEGO) sensor (also referred to as a wide band or wide range EGO sensor), or another suitable type of EGO sensor. A switching EGO sensor generates an EGO signal in units of voltage, and switches the EGO signal between a low voltage (e.g., approximately 0.1 V) and a high voltage (e.g., approximately 0.8 V) when the oxygen concentration is lean and rich, respectively. A UEGO sensor generates an EGO signal that corresponds to an equivalence ratio (EQR) of the exhaust gas and provides measurements between rich and lean.

Figure 2:
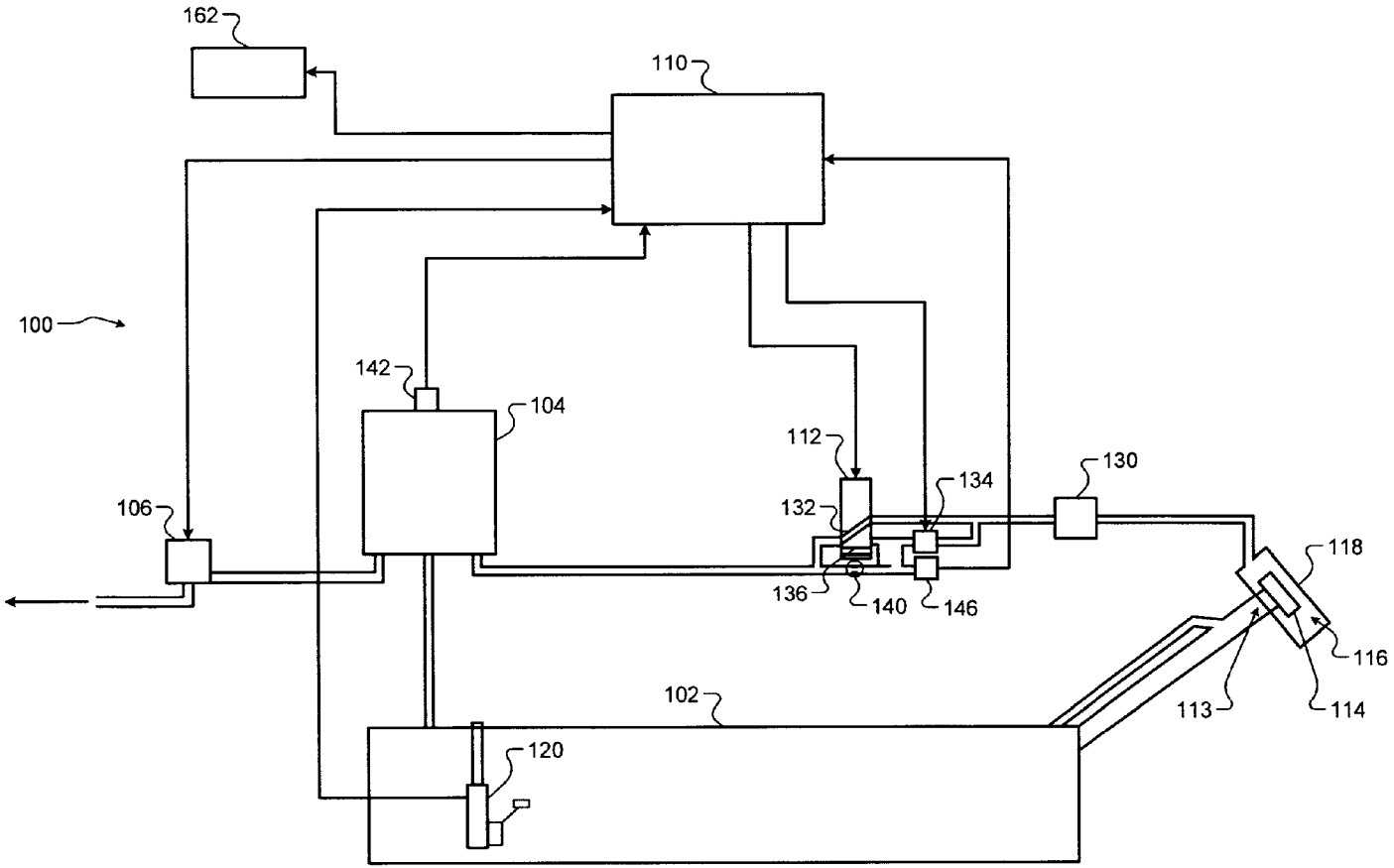
FIG. 2 is a functional block diagram of an example fuel control system according to the present application.

Referring now to FIG. 2, a functional block diagram of an example fuel control system is presented. A fuel system 100 supplies liquid fuel and fuel vapor to the engine 12. The fuel system 100 includes a fuel tank 102 that contains liquid fuel. Liquid fuel is drawn from the fuel tank 102 and supplied to the fuel injectors by one or more fuel pumps (not shown).

Some conditions, such as heat, vibration, and/or radiation, may cause liquid fuel within the fuel tank 102 to vaporize. A vapor canister 104 traps and stores vaporized fuel (fuel vapor). The vapor canister 104 may include one or more substances that trap and store fuel vapor, such as one or more types of charcoal.

Operation of the engine 12 creates a vacuum within the intake manifold 24. A purge valve 106 may be selectively opened to draw fuel vapor from the vapor canister 104 to the intake manifold 24. A purge control module 110 controls the purge valve 106 to control the flow of fuel vapor to the engine 12. While the purge control module 110 and the ECM 30 are shown and discussed as being independent modules, the ECM 30 may include the purge control module 110.

The purge control module 110 also controls a switching (vent) valve 112. When the switching valve 112 is in a vent position, the purge control module 110 may selectively open the purge valve 106 to purge fuel vapor from the vapor canister 104 to the intake manifold 24. The purge control module 110 may control the rate at which fuel vapor is purged from the vapor canister 104 (a purge rate) by controlling opening and closing of the purge valve 106. For example only, the purge valve 106 may include a solenoid valve, and the purge control module 110 may control the purge rate by controlling duty cycle of a signal applied to the purge valve 106. The purge control module 110 may control the purge rate, for example, to achieve a target purge rate.

The vacuum within the intake manifold 24 draws fuel vapor from the vapor canister 104 through the purge valve 106 to the intake manifold 24. The purge rate may be determined based on the duty cycle of the signal applied to the purge valve 106, pressure within the intake manifold 24, and the amount of fuel vapor within the vapor canister 104. Ambient air is drawn into the vapor canister 104 through the switching valve 112 as fuel vapor is drawn from the vapor canister 104.

The purge control module 110 actuates the switching valve 112 to the vent position and controls the duty cycle of the purge valve 106 while the engine 12 is running. When the engine 12 not running (e.g., key OFF), the purge control module 110 may actuate the purge valve 106 to the closed position. In this manner, the purge valve 106 is maintained in the closed position when the engine 12 is not running.

A driver of the vehicle may add liquid fuel to the fuel tank 102 via a fuel inlet 113. A fuel cap 114 seals the fuel inlet 113. The fuel cap 114 and the fuel inlet 113 may be accessed via a fueling compartment 116. A fuel door 118 may be implemented to shield and close the fueling compartment 116.

A fuel level sensor 120 measures an amount of liquid fuel within the fuel tank 102. The fuel level sensor 120 generates a fuel level signal based on the amount of liquid fuel within the fuel tank 102. For example only, the amount of liquid fuel in the fuel tank 102 may be expressed as a volume, a percentage of a maximum volume of the fuel tank 102, or another suitable measure of the amount of fuel in the fuel tank 102.

The ambient air provided to the vapor canister 104 through the switching valve 112 may be drawn from the fueling compartment 116. A filter 130 receives the ambient air and filters various particulate from the ambient air. For example only, the filter 130 may filter particulate having a dimension of greater than a predetermined dimension, such as approximately 5 microns.

The switching valve 112 may be actuated to the vent position or to a pump position at a given time. The switching valve 112 is shown as being in the vent position in the example of FIG. 2. When the switching valve 112 is in the vent position, air can flow from the filter 130 to the vapor canister 104 via a first path 132 through the switching valve 112. When the switching valve 112 is in the pump position, air can flow between a vacuum pump 134 and the vapor canister 104 via a second path 136 through the switching valve 112.

When the vacuum pump 134 is activated while the switching valve 112 is in the pump position, the vacuum pump 134 may draw gasses (e.g., air) through the switching valve 112 and expel the gasses through the filter 130. The vacuum pump 134 may draw the gasses through the second path 136 and a reference orifice 140. A relief valve (not shown) may be implemented to selectively discharge pressure or vacuum within the fuel system 100.

A first pressure sensor 142 measures a first pressure within the fuel tank 102 and generates a first pressure signal based on the first pressure. For example only, the first pressure sensor 142 may be located at a top of the vapor canister 104. In various implementations, the first pressure sensor 142 may measure vacuum within the fuel tank 102 where the vacuum is measured relative to ambient pressure. The first pressure sensor 142 may also be referred to as a tank pressure sensor.

A second pressure sensor 146 measures a second pressure and generates a second pressure signal based on the second pressure. The second pressure measured by the second pressure sensor 146 may be based on whether the switching valve 112 is in the pump position or the vent position. When the switching valve 112 is in the pump position, the pressure measured by the second pressure sensor 146 should be approximately equal to the first pressure. When the switching valve 112 is in the vent position, the pressure measured by the second pressure sensor 146 may approach ambient air pressure.

The purge control module 110 may selectively perform a fuel system leak test, such as once per key cycle of the vehicle. The fuel system leak test involves controlling the switching valve 112 and the purge valve 106 to determine whether a leak of at least a predetermined size is present in the fuel system 100. The purge control module 110 maintains the switching valve 112 in the pump position for a fuel system leak test. In this manner, the purge control module 110 prevents ambient airflow into the fuel system 100 during the fuel system leak test. The purge control module 110 may or may not operate the vacuum pump 134 for the fuel system leak test.

While the switching valve 112 is in the pump position, the purge control module 110 selectively opens and closes the purge valve 106 for the fuel system leak test. As ambient airflow into the fuel system 100 is blocked during the fuel system leak test, vacuum within the fuel tank 102 should increase as fuel vapor is drawn toward the intake manifold 24 through the purge valve 106.

The purge control module 110 may determine and indicate whether the leak is present in the fuel system 100 based on whether the vacuum within the fuel tank 102 becomes greater than a predetermined vacuum. If the vacuum becomes greater than the predetermined vacuum, the purge control module 110 may indicate that the leak is not present in the fuel system 100. If the vacuum does not become greater than the predetermined vacuum within a predetermined period or if more than a predetermined volume of gas (e.g., fuel vapor and/or air) is drawn through the purge valve 106 during the fuel system leak test, the purge control module 110 may indicate that the leak is present in the fuel system 100.

One or more remedial actions may be taken when the leak is present. For example, the purge control module 110 may set one or more a predetermined codes (e.g., a diagnostic trouble code(s)) in memory, activate an indicator lamp 162 (e.g., a malfunction indicator lamp or MIL), and/or perform one or more other suitable remedial actions.

The indicator lamp 162 may, for example, indicate that it may be appropriate to seek servicing for the vehicle. Upon servicing the vehicle, a vehicle service technician may access the memory. The one or more predetermined codes set may serve to indicate to the vehicle service technician that the fuel system 100 includes a leak.

Figure 3:
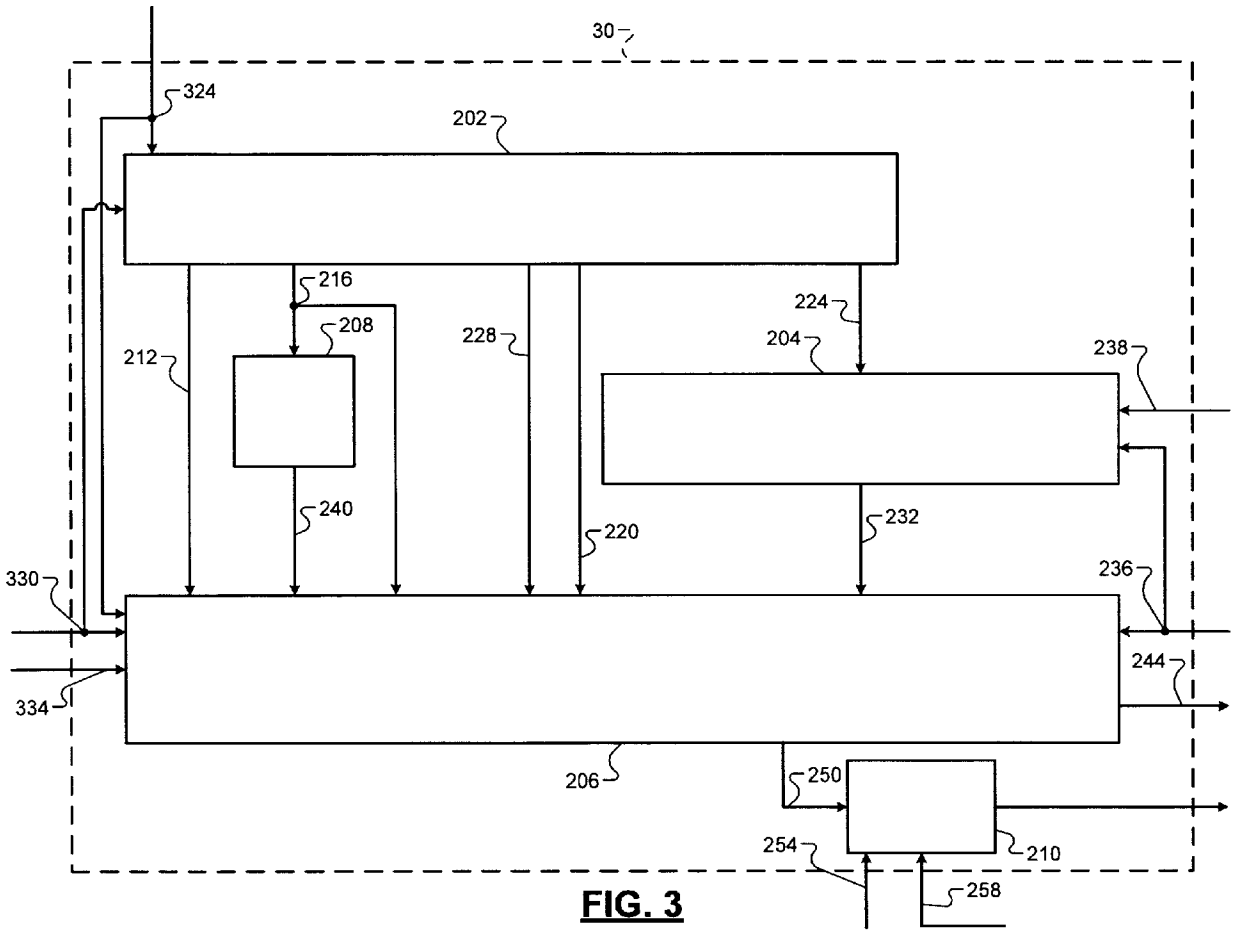
FIG. 3 is a functional block diagram of an example engine control module according to the present application.

Referring now to FIG. 3, a functional block diagram of a portion of an example implementation of the ECM 30 is presented. The ECM 30 may include a command generator module 202, an outer loop module 204, an inner loop module 206, a reference generation module 208, and a fault detection module 210.

The command generator module 202 may determine one or more engine operating conditions. For example only, the engine operating conditions may include, but are not limited to, engine speed 212, air per cylinder (APC), engine load 216, and/or other suitable parameters. The APC may be predicted for one or more future combustion events in some engine systems. The engine load 216 may be determined based on, for example, a ratio of the APC to a maximum APC of the engine 12. The engine load 216 may alternatively be determined based on an indicated mean effective pressure (IMEP), engine torque, or another suitable parameter indicative of engine load.

The command generator module 202 generates a base equivalence ratio (EQR) request 220. The base EQR request 220 may be generated, for example, based on an APC and to achieve a desired equivalence ratio (EQR) of the air/fuel mixture. For example only, the desired EQR may include a stoichiometric EQR (i.e., 1.0). The command generator module 202 also determines a desired downstream exhaust gas output (a desired DS EGO) 224. The command generator module 202 may determine the desired DS EGO 224 based on, for example, one or more of the engine operating conditions.

The command generator module 202 may also generate one or more open-loop fueling corrections 228 for the base EQR request 220. The open-loop fueling corrections 228 may include, for example, a sensor correction and an error correction. For example only, the sensor correction may correspond to a correction to the base EQR request 220 to accommodate the measurements of the US EGO sensor 38. The error correction may correspond to a correction in the base EQR request 220 to account for errors that may occur, such as errors in the determination of the APC and errors attributable to fuel vapor purging.

The outer loop module 204 may also generate one or more open-loop fueling corrections 232 for the base EQR request 220. The outer loop module 204 may generate, for example, an oxygen storage correction and an oxygen storage maintenance correction. For example only, the oxygen storage correction may correspond to a correction in the base EQR request 220 to adjust the oxygen storage of the catalyst 28 to a desired oxygen storage within a predetermined period. The oxygen storage maintenance correction may correspond to a correction in the base EQR request 220 to modulate the oxygen storage of the catalyst 28 at approximately the desired oxygen storage.

The outer loop module 204 may estimate the oxygen storage of the catalyst 28 based on the US EGO signal 236 (generated by the US EGO sensor 38) and the DS EGO signal 238 (generated by the DS EGO sensor 40). The outer loop module 204 may generate the open-loop fueling corrections 232 to adjust the oxygen storage of the catalyst 28 to the desired oxygen storage and/or to maintain the oxygen storage at approximately the desired oxygen storage. The outer loop module 204 may also generate the open-loop fueling corrections 232 to minimize a difference between the DS EGO signal 238 and the desired DS EGO 224.

The inner loop module 206 (see also FIG. 4) determines an upstream EGO error based on a difference between the US EGO signal 236 and an expected US EGO. The US EGO error may correspond to, for example, a correction in the base EQR request 220 to minimize the difference between the US EGO signal 236 and the expected US EGO. The inner loop module 206 normalizes the US EGO error to produce a normalized error 250 and selectively adjusts the base EQR request 220 based on the normalized error 250.

The inner loop module 206 also determines an imbalance (fueling) correction for the cylinder 25. The inner loop module 206 determines an imbalance correction for each of the cylinders. The imbalance corrections may also be referred to as individual cylinder fuel correction (ICFCs) or fueling corrections. The imbalance correction for a cylinder may correspond to, for example, a correction in the base EQR request 220 to balance an output of the cylinder with output of the other cylinders.

The reference generation module 208 generates a reference signal 240. For example only, the reference signal 240 may include a sinusoidal wave, triangular wave, or another suitable type of periodic signal. The reference generation module 208 may selectively vary the amplitude and frequency of the reference signal 240. For example only, the reference generation module 208 may increase the frequency and amplitude as the engine load 216 increases and vice versa. The reference signal 240 may be provided to the inner loop module 206 and one or more other modules.

The reference signal 240 may be used in determining a final EQR request 244 to toggle the EQR of the exhaust gas provided to the catalyst 28 back and forth between a predetermined rich EQR and a predetermined lean EQR. For example only, the predetermined rich EQR may be approximately 3 percent rich (e.g., an EQR of 1.03), and the predetermined lean EQR may be approximately 3 percent lean (e.g., an EQR of approximately 0.97). Toggling the EQR may improve the efficiency of the catalyst 28. Additionally, toggling the EQR may be useful in diagnosing faults in the US EGO sensor 38, the catalyst 28, and/or the DS EGO sensor 40.

The inner loop module 206 determines the final EQR request 244 based on the base EQR request 220 and the normalized error 250. The inner loop module 206 determines the final EQR request 244 further based on the sensor correction, the error correction, the oxygen storage correction, and the oxygen storage maintenance correction, the reference signal 240, and the imbalance correction for the cylinder 25. The ECM 30 controls the fuel injection system 16 based on the final EQR request 244. For example only, the ECM 30 may control the fuel injection system 16 using pulse width modulation (PWM).

The fault detection module 210 (see also FIG. 5) determines whether a fault is present in the US EGO sensor 38 based on the normalized error 250 and an error threshold. The fault detection module 210 determines the error threshold based on a (fuel vapor) purge rate 254. The purge rate 254 may be, for example, an estimated rate at which fuel vapor is presently being purged from the vapor canister 104 or a commanded purge rate. During performance of the fuel system leak test, the fault detection module 210 may optionally disable the determination of whether a fault is present in the US EGO sensor 38. A leak test state 258 indicates whether the fuel system leak test is active or inactive.

Figure 4:
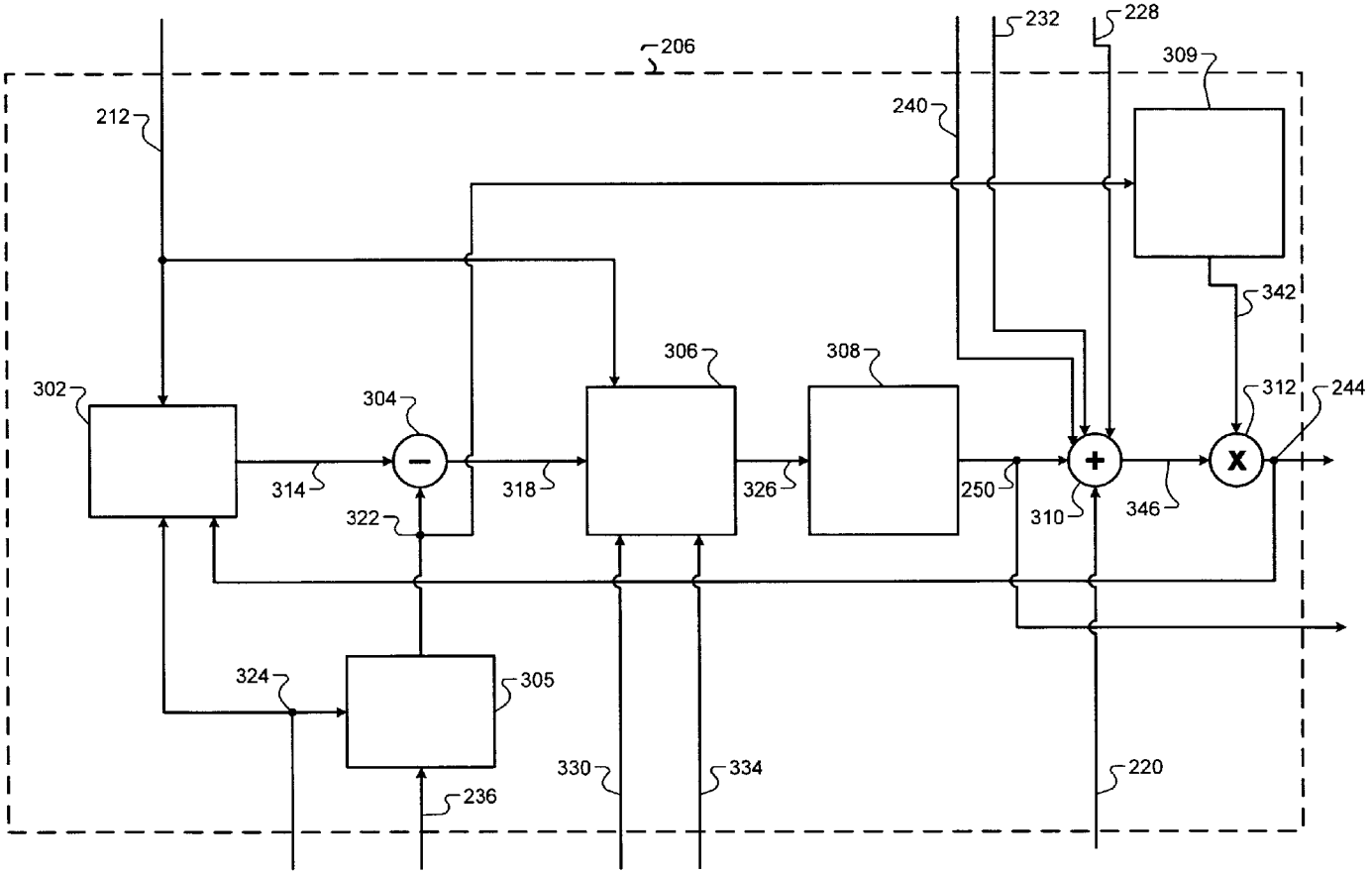
FIG. 4 is a functional block diagram of an example inner loop module according to the present application.

Referring now to FIG. 4, a functional block diagram of an example implementation of the inner loop module 206 is presented. The inner loop module 206 may include an expected US EGO module 302, an error module 304, a sampling module 305, a scaling module 306, and a normalization module 308. The inner loop module 206 may also include an imbalance correction module 309, an initial EQR module 310, and a final EQR module 312.

The expected US EGO module 302 determines the expected US EGO 314. In implementations where the US EGO sensor 38 is a WRAF sensor or a UEGO sensor, the expected US EGO module 302 determines the expected US EGO 314 based on the final EQR request 244. The expected US EGO 314 corresponds to an expected value of a given sample of the US EGO signal 236. However, delays of the engine system 10 prevent the exhaust gas resulting from combustion from being immediately reflected in the US EGO signal 236. The delays of the engine system 10 may include, for example, an engine delay, a transport delay, and a sensor delay.

The engine delay may correspond to a period between, for example, when fuel is provided to a cylinder of the engine 12 and when the resulting exhaust is expelled from the cylinder. The transport delay may correspond to a period between when the resulting exhaust is expelled from the cylinder and when the resulting exhaust reaches the location of the US EGO sensor 38. The sensor delay may correspond to the delay between when the resulting exhaust reaches the location of the US EGO sensor 38 and when the resulting exhaust is reflected in the US EGO signal 236.

The US EGO signal 236 may also reflect a mixture of the exhaust produced by different cylinders of the engine 12. The expected US EGO module 302 accounts for exhaust mixing and the engine, transport, and sensor delays in determining the expected US EGO 314. The expected US EGO module 302 stores the EQR of the final EQR request 244. The expected US EGO module 302 determines the expected US EGO 314 based on one or more stored EQRs, exhaust mixing, and the engine, transport, and sensor delays.

The error module 304 determines an upstream EGO error (US EGO error) 318 based on a sample of the US EGO signal (a US EGO sample) 322 taken at a given sampling time and the expected US EGO 314 for the given sampling time. More specifically, the error module 304 determines the US EGO error 318 based on a difference between the US EGO sample 322 and the expected US EGO 314.

The sampling module 305 selectively samples the US EGO signal 236 and provides the samples to the error module 304. The sampling module 305 may sample the US EGO signal 236 at a predetermined rate, such as once per predetermined number of crankshaft angle degrees (CAD) as indicated by a crankshaft position 324 measured using the crankshaft position sensor 36. The predetermined rate may be set, for example, based on the number of cylinders of the engine 12, the number of EGO sensors implemented, the firing order of the cylinders, and a configuration of the engine 12. For example only, for a four cylinder engine with one cylinder bank and one EGO sensor, the predetermined rate may be approximately eight CAD based samples per engine cycle or another suitable rate.

The scaling module 306 determines a scaled error 326 based on the US EGO error 318. The scaling module 306 may apply one or more gains or other suitable control factors in determining the scaled error 326 based on the US EGO error 318. For example only, the scaling module 306 may determine the scaled error 326 using the equation:

$$\text{Scaled Error} = \frac{MAF}{14.7} * US\ EGO\ \text{Error}, \tag{1}$$

where Scaled Error is the scaled error 326, MAF is a MAF 330 measured using the MAF sensor 32, and US EGO Error is the US EGO error 318.

The scaling module 306 may determine the scaled error 326 using the relationship:

$$\text{Scaled Error} = k(\text{MAP},\text{RPM}) * \text{US EGO Error}, \tag{2}$$

where RPM is the engine speed 212, MAP is a MAP 334 measured using the MAP sensor 34, k is a function of the MAP 334 and the engine speed 212, and US EGO Error is the US EGO error 318. In some implementations, k may be additionally or alternatively be a function of the engine load 216.

The normalization module 308 determines the normalized error 250 based on the scaled error 326. For example only, the normalization module 308 may include a proportional-integral (PI) controller, a proportional (P) controller, an integral (I) controller, or a proportional-integral-derivative (PID) controller that determines the normalized error 250 based on the scaled error 326.

In implementations involving a switching air/fuel sensor or a switching EGO sensor, the expected US EGO 314 may be set to the current commanded fueling state (i.e., the predetermined rich state or the predetermined lean state). The normalization module 308 determines the normalized error 250 based on a period that the US EGO signal 236 (or the samples) is different than the expected US EGO 314. In this manner, the normalized error 250 is determined based on the period that the US EGO sensor 38 indicates the previous commanded fueling state after a transition from the previous commanded fueling state to the current commanded fueling state.

The imbalance correction module 309 monitors the US EGO samples 322 of the US EGO signal 236. The imbalance correction module 309 determines imbalance values for the cylinders of the engine 12 based on the (present) US EGO sample 322 and an average of a predetermined number of previous US EGO samples 322. The imbalance correction module 309 determines an offset value that relates (associates) one of the imbalance values to (with) one of the cylinders of the engine 12. The imbalance correction module 309 correlates the other cylinders of the engine with the other imbalance values, respectively, based on the firing order of the cylinders. The imbalance correction module 309 determines imbalance (fueling) corrections for the cylinders of the engine 12 based on the imbalance values associated with the cylinders, respectively. For example, the imbalance correction module 309 may determine an imbalance correction 342 for the cylinder 25 based on the imbalance value associated with the cylinder 25.

The initial EQR module 310 determines an initial EQR request 346 based on the base EQR request 220, the reference signal 240, the normalized error 250, and the open-loop fueling correction(s) 228 and 232. For example only, the initial EQR module 310 may determine the initial EQR request 346 based on the sum of the base EQR request 220, the reference signal 240, the normalized error 250, and the open-loop fueling correction(s) 228 and 232.

The final EQR module 312 determines the final EQR request 244 based on the initial EQR request 346 and the imbalance correction 342. More specifically, the final EQR module 312 corrects the initial EQR request 346 based on the imbalance correction 342 that is associated with the next cylinder in the firing order. The final EQR module 312 may, for example, set the final EQR request 244 equal to a product of the initial EQR request 346 and the imbalance correction 342 or to a sum of the initial EQR request 346 and the imbalance correction 342. The fuel injection system 16 controls fuel injection for the next cylinder in the firing order based on the final EQR request 244.

Figure 5:
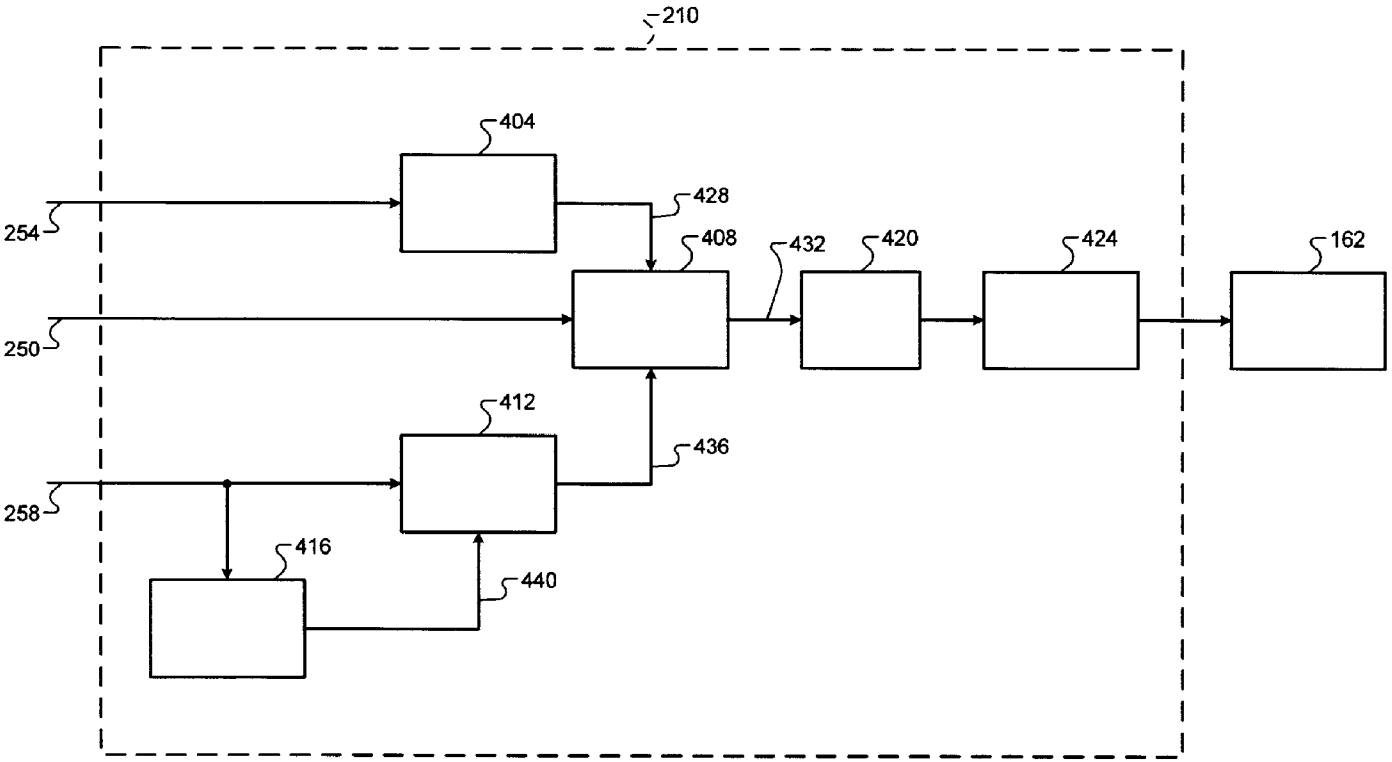
FIG. 5 is a functional block diagram of an example fault detection module according to the present application.

Referring now to FIG. 5, a functional block diagram of an example implementation of the fault detection module 210 is presented. The fault detection module 210 may include a threshold determination module 404, a fault indication module 408, a disabling module 412, a timer module 416, memory 420, and a monitoring module 424.

The threshold determination module 404 determines the error threshold 428 based on the purge rate 254. For example, the threshold determination module may determine the error threshold 428 using one of a function and a mapping that relates the purge rate 254 to the error threshold 428. As a function of the purge rate 254, the error threshold 428 may be bell shaped. In other words, the error threshold 428 may generally increase as the purge rate 254 increases up to a predetermined purge rate. As the purge rate increases above the predetermined purge rate, the error threshold 428 may generally decrease.

The purge rate 254 may be, for example, the present rate (e.g., mass flow rate, amount, etc.) at which fuel vapor is being purged from the vapor canister 104 to the intake manifold 24 or a purge rate commanded by the purge control module 110. The mass flow rate at which fuel vapor is being purged may be determined by the purge control module 110 and/or a module of the ECM 30, for example, based on the amount of fuel vapor within the vapor canister 104, the pressure within the intake manifold 24, and the opening (e.g., duty cycle) of the purge valve 106. If the present rate is expressed as an amount, the purge rate 254 may be determined, for example, based on an integral of the mass flow rate over a period of time.

When enabled, the fault indication module 408 determines whether a fault is present in the US EGO sensor 38. The fault indication module 408 determines whether a fault is present in the US EGO sensor 38 based on the normalized error 250 and the error threshold 428. The fault indication module 408 determines that the fault is present in the US EGO sensor 38 when the normalized error 250 is greater than the error threshold 428. When the normalized error 250 is less than the error threshold 428, the fault indication module 408 may determine that the fault is not present in the US EGO sensor 38.

The fault indication module 408 generates a fault signal 432 that indicates whether the fault is present in the US EGO sensor 38. For example, the fault indication module 408 may set a predetermined code (e.g., diagnostic trouble code, DTC) in the memory 420 when the fault is present in the US EGO sensor 38.

The monitoring module 424 monitors the memory 420. The monitoring module 424 illuminates the indicator lamp 162 in response to the setting of the predetermined code or in response to the fault indication module 408 indicating that the fault is present in the US EGO sensor 38.

One or more remedial actions may additionally or alternatively be taken in response to the fault indication module 408 indicating that the fault is present in the US EGO sensor 38. For example, when the fault is present in the US EGO sensor 38, the inner loop module 206 may generate the final EQR request 244 independently of the normalized error 250 (which is generated based on the US EGO signal 236).

The disabling module 412 selectively enables and disables the fault indication module 408. The disabling module 412 may enable and disable the fault indication module 408 via an enable/disable signal 436. The disabling module 412 may enable and disable the fault indication module 408 based on the leak test state 258 and/or a test OFF period 440. For example, the disabling module 412 disables the fault indication module 408 when the leak test state 258 is in an active state (i.e., while the fuel system leak test is being performed).

The timer module 416 resets the test OFF period 440 to a predetermined reset value (e.g., zero) when the leak test state 258 is in the active state. When the leak test state 258 is in an inactive state (i.e., while the fuel system leak test is not being performed), the timer module 416 increments the test OFF period 440. In this manner, the test OFF period 440 tracks the period that has passed since the last fuel system leak test ended.

The disabling module 412 also disables the fault indication module 408 when the test OFF period 440 is less than a predetermined period. The predetermined period may be calibratable and may be set based on a period for the normalized error 250 to stabilize after a fuel system leak test ends. Disabling the fault indication module 408 may prevent the fault indication module 408 from incorrectly determining and indicating that a fault is present in the US EGO sensor 38. When the test OFF period 440 is greater than the predetermined period and the leak test state 258 is in the inactive state, the disabling module 412 may enable the fault indication module 408.

Figure 6:
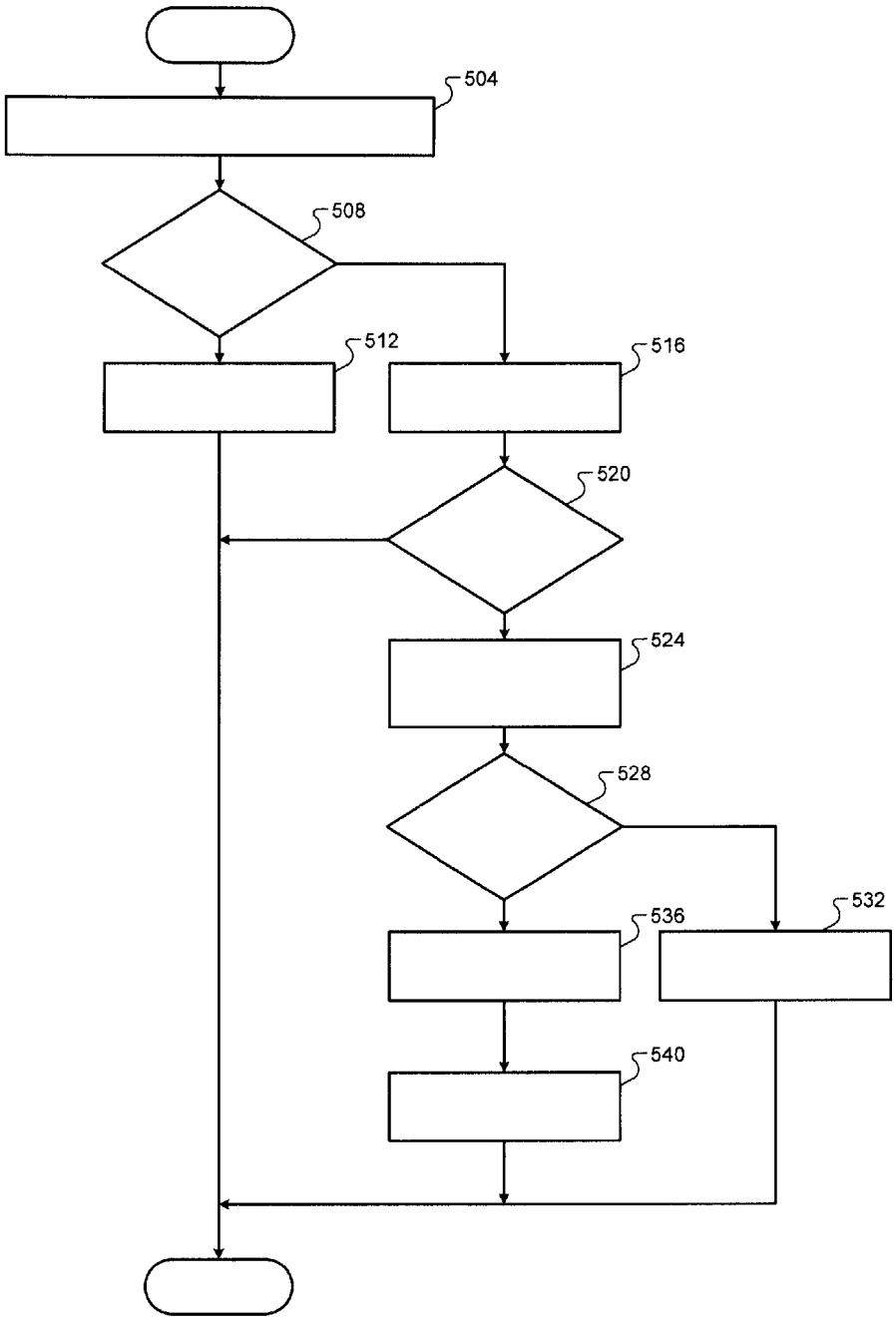
FIG. 6 is a flowchart depicting an example method of detecting a fault in an exhaust gas oxygen sensor located upstream of a catalyst according to the present application.

Referring now to FIG. 6, a flowchart depicting an example method of identifying a fault in the US EGO sensor 38 is presented. At 504, the inner loop module 206 generates the normalized error 250 based on the US EGO signal 236 and an expected value of the US EGO signal 236. The inner loop module 206 generates the normalized error 250 as described above.

At 508, the disabling module 412 determines whether the fuel system leak test is being performed. For example, the disabling module 412 may determine whether the leak test state 258 is in the active state at 508. If true, the timer module 416 may reset the test OFF period 440 to the predetermined reset value and the disabling module 412 may disable the fault indication module 408 at 512, and control may end. If false, control may continue with 516.

At 516, the timer module 416 may increment the test OFF period 440 by a predetermined increment amount. The disabling module 412 may determine whether the test OFF period 440 is greater than the predetermined period at 520. If false, the disabling module 412 may disable the fault indication module 408, and control may end. If true, control may continue with 524. While incrementing of the test OFF period 440, resetting the test OFF period 440 to zero, and determining whether the test OFF period 440 is greater than the predetermined period have been discussed, resetting the test OFF period 440 based on the predetermined period, decrementing the test OFF period 440, and determining whether the test OFF period 440 is less than or equal to zero may be used.

At 524, the threshold determination module 404 determines the error threshold 428 based on the purge rate 254. The threshold determination module 404 may determine the error threshold 428, for example, using a function or a mapping that relates the purge rate 254 to the error threshold 428.

The fault indication module 408 determines whether the normalized error 250 is greater than the error threshold 428 at 528. If false, the fault indication module 408 indicates that the fault is not present in the US EGO sensor 38 at 532, and control may end. If true, the fault indication module 408 indicates that the fault is present in the US EGO sensor 38 at 536. The fault indication module 408 may, for example, set the predetermined code in the memory 420.

At 540, one or more remedial actions may be taken in response to the indication that the fault is present in the US EGO sensor 38. For example, at 540, the monitoring module 424 may illuminate the indicator lamp 162, the inner loop module 206 may generate the final EQR request 244 independent of the normalized error 250, and/or one or more other suitable remedial actions may be taken. Control may then end. While control is shown and discussed as ending, FIG. 6 may be illustrative of one control loop, and control loops may be performed at a predetermined rate, such as every 25 milliseconds or another suitable rate.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); a discrete circuit; an integrated circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be partially or fully implemented by one or more computer programs executed by one or more processors. The computer programs include processor-executable instructions that are stored on at least one non-transitory tangible computer readable medium. The computer programs may also include and/or rely on stored data. Non-limiting examples of the non-transitory tangible computer readable medium include nonvolatile memory, volatile memory, magnetic storage, and optical storage.

What is claimed is:

1. A diagnostic system for a vehicle, comprising:

an error module that determines an error value based on a difference between an amount of oxygen in exhaust measured by an exhaust gas oxygen sensor (EGO) upstream of a catalyst and an expected value of the amount;

an equivalence ratio (EQR) module that selectively controls fuel injection based on the error value;

a threshold determination module that determines an error threshold based on a flow rate of fuel vapor from a vapor canister to an intake manifold of an engine; and a fault indication module that selectively indicates that a fault is present in the EGO sensor based on the error value and the error threshold.

2. The diagnostic system of claim 1 further comprising:

a scaling module that generates a scaled error value based on the error value; and a normalization module that generates a normalized error value based on the scaled error, wherein the fault indication module selectively indicates that the fault is present in the EGO sensor based on a comparison of the normalized error value and the error threshold.

3. The diagnostic system of claim 2 wherein the fault indication module indicates that the fault is present in the EGO sensor when the normalized error value is greater than the error threshold and indicates that the fault is not present in the EGO sensor when the normalized error value is less than the error threshold.

4. The diagnostic system of claim 3 wherein the EQR module controls the fuel injection as a function of the normalized error value in response to the fault indication module indicating that the fault is not present in the EGO sensor, and wherein the EQR module controls the fuel injection independently of the normalized error value in response to the fault indication module indicating that the fault is present in the EGO sensor.

5. The diagnostic system of claim 1 further comprising a purge control module that selectively initiates a leak test, that blocks airflow into the vapor canister and enables fuel vapor flow to the intake manifold during the leak test, and that indicates whether a leak is present in a fuel system based on a pressure within a fuel tank measured during the leak test.

6. The diagnostic system of claim 5 further comprising a disabling module that disables the fault indication module during the leak test.

7. The diagnostic system of claim 6 wherein the disabling module disables the fault indication for a predetermined period after the leak test ends.

8. The diagnostic system of claim 1 wherein the threshold determination module determines the error threshold as a function of the flow rate of fuel vapor from the vapor canister to the intake manifold.

9. The diagnostic system of claim 1 wherein the fault indication module sets a predetermined code in memory when the fault is present in the EGO sensor.

10. The diagnostic system of claim 9 further comprising a monitoring module that illuminates an indicator lamp in response to the setting of the predetermined code in memory.

11. A diagnostic method for a vehicle, comprising:

determining an error value based on a difference between an amount of oxygen in exhaust measured by an exhaust gas oxygen sensor (EGO) upstream of a catalyst and an expected value of the amount;

selectively controlling fuel injection based on the error value;

determining an error threshold based on a flow rate of fuel vapor from a vapor canister to an intake manifold of an engine; and selectively indicating that a fault is present in the EGO sensor based on the error value and the error threshold.

12. The diagnostic method of claim 11 further comprising:

generating a scaled error value based on the error value;

generating a normalized error value based on the scaled error; and selectively indicating that the fault is present in the EGO sensor based on a comparison of the normalized error value and the error threshold.

13. The diagnostic method of claim 12 further comprising:

indicating that the fault is present in the EGO sensor when the normalized error value is greater than the error threshold; and indicating that the fault is not present in the EGO sensor when the normalized error value is less than the error threshold.

14. The diagnostic method of claim 13 further comprising:

controlling the fuel injection as a function of the normalized error value in response to an indication that the fault is not present in the EGO sensor; and controlling the fuel injection independently of the normalized error value in response to an indication that the fault is present in the EGO sensor.

15. The diagnostic method of claim 11 further comprising:

selectively initiating a leak test;

blocking airflow into the vapor canister and enabling fuel vapor flow to the intake manifold during the leak test; and indicating whether a leak is present in a fuel system based on a pressure within a fuel tank measured during the leak test.

16. The diagnostic method of claim 15 further comprising preventing the selective indication that the fault is present in the EGO sensor during the leak test.

17. The diagnostic method of claim 16 further comprising preventing the selective indication that the fault is present in the EGO sensor for a predetermined period after the leak test ends.

18. The diagnostic method of claim 11 further comprising determining the error threshold as a function of the flow rate of fuel vapor from the vapor canister to the intake manifold.

19. The diagnostic method of claim 11 further comprising setting a predetermined code in memory when the fault is present in the EGO sensor.

20. The diagnostic method of claim 19 further comprising illuminating an indicator lamp in response to the setting of the predetermined code in memory.

* * * * *